US005222541A

United States Patent [19]

Hornberger

[11] Patent Number: 5,222,541

[45] Date of Patent: Jun. 29, 1993

[54] INDUSTRIAL DOOR HAVING RELEASABLE BEAM AND TENSION BRACKET RETENTION MECHANISM

[75] Inventor: Timothy G. Hornberger, Jackson, Wis.

[73] Assignee: Kelley Company, Inc., Milwaukee, Wis.

[21] Appl. No.: 919,036

[22] Filed: Jul. 22, 1992

[51] Int. Cl.[5] ..... A47H 1/00

[52] U.S. Cl. ..... 160/265; 160/310; 160/190

[58] Field of Search ..... 160/265, 319, 310, 311, 160/267.1, 268.1, 189, 190, 193

[56] References Cited

U.S. PATENT DOCUMENTS

| | | | |
|---|---|---|---|
| 1,762,480 | 6/1930 | Marenti | 160/310 X |
| 2,428,170 | 9/1947 | McDonald . | |
| 2,754,899 | 7/1956 | Karobonik et al. | 160/310 X |
| 4,478,268 | 10/1984 | Palmer | 160/314 |
| 4,690,194 | 9/1987 | Seuster | 160/265 |
| 4,770,224 | 9/1988 | Dubbelman | 160/331 |
| 4,800,946 | 1/1989 | Rosenoy | 160/264 |
| 4,887,660 | 12/1989 | Kraus | 160/310 X |
| 4,997,022 | 3/1991 | Klein | 160/322 X |
| 5,025,847 | 6/1991 | Mueller | 160/270 |
| 5,048,588 | 9/1991 | Weishar | 160/265 |
| 5,078,197 | 1/1991 | Weisher | 160/265 |
| 5,129,442 | 7/1992 | Warner | 160/265 X |
| 5,139,074 | 8/1992 | Warner | 160/271 |

FOREIGN PATENT DOCUMENTS

| | | |
|---|---|---|
| 271779 | 9/1968 | Fed. Rep. of Germany . |
| 264999 | 2/1927 | United Kingdom . |

*Primary Examiner*—Blair M. Johnson

*Attorney, Agent, or Firm*—Andrus, Sceales, Starke & Sawall

[57] ABSTRACT

An industrial roll-up door, having a releasable beam and a tension bracket retention mechanism. The door includes a flexible door panel, which is wound in coiled form on a drum, and an elongated beam is attached to the lower end of the door panel. The ends of the beam are releasably connected to brackets that can be movable in vertical guide tracks mounted along the sides of the doorway. A biasing mechanism attached to each bracket exerts a downward tensioning force on the door panel when in the closed position. A pair of belts each having the same thickness as the door panel are wound on the drum adjacent the side edges of the door panel, and the free end of each belt is connected to the respective bracket. If the beam is released from the brackets by virtue of the door panel, when in the closed or partially open position, being subjected to a transverse impact, the connection of the belts to the brackets will resist the biasing force and retain the brackets at the same proximate vertical level as the beam so that the ends of the beam can be conveniently reattached to the brackets.

17 Claims, 2 Drawing Sheets

INDUSTRIAL DOOR HAVING RELEASABLE BEAM AND TENSION BRACKET RETENTION MECHANISM

BACKGROUND OF THE INVENTION

Roll-up doors are used in commercial or industrial establishments to separate different areas of a building or to separate the inside of the building from the exterior. For example, roll-up doors may be used to separate two areas or zones which have different temperature or humidity conditions, or to provide noise control between two areas. A roll-up door has the advantage of being capable of being moved rapidly between the open and closed positions, and when in the open position, the door panel or curtain is wound on a drum located above the doorway so that the door panel will not obstruct the doorway.

The typical roll-up door includes a counterbalancing mechanism to counterbalance the weight of the door panel, and also incorporates a tensioning system which is arranged to exert a downward force on the door panel to stretch the door panel when in the closed or partially closed positions.

The conventional roll-up door also includes a horizontal beam that is attached to the lower edge of the flexible door panel. The operation of the roll-up door is normally initiated by the operator of a forklift truck, either by the operator pulling on a suspended cable, or by the forklift truck passing over a floor treadle. In the case of a power failure, or in a situation where the forklift operator may not fully actuate or pull the cable, or in the event that the forklift operator does not properly judge the speed of the forklift truck with the opening rate of the door, the forklift truck may engage the door panel and beam with substantial impact. The impact can bend or deform the beam, or rip the fabric door panel away from the beam, or damage the guide mechanism in the side frames of the door.

Because of this problem, it has been proposed to incorporate a breakaway mechanism with the beam of a roll-up door and one such breakaway mechanism is that described in U S. patent application 07/679,770, filed Apr. 3, 1991, U.S. Pat. No. 5,139,074. With the breakaway mechanism of that patent application, the beam is formed of a flexible material, and each end of the beam is formed with an open-ended slot or recess. Guide brackets are mounted for vertical sliding movement within guide tracks in the side frames of the door, and each guide bracket is provided with an extension which is freely slidable in the slot in the end of the beam. With the flexible nature of the beam, a minor bump against the beam will merely flex the beam, and move the guide extensions longitudinally in the slot without releasing the guide extensions from the slots. On the other hand, if the beam is subjected to a substantial external transverse impact, the beam will initially deflect and continued deformation of the beam will release the guide extensions from the beam ends.

Another typical breakaway mechanism includes a T-shaped guide bracket extension, and the beam end has a mating T-shaped slot. With this construction, the beam will move transversely when subjected to an external impact to thereby release the connection of the beam ends to the guide brackets.

The tensioning mechanism utilized in a conventional roll-up door exerts a downward biasing force on the guide brackets, and when the beam breaks away from the guide brackets, the biasing force will drive the guide brackets downwardly within the guide tracks. As the biasing force is of substantial magnitude, the guide brackets or other components can be damaged. Moreover, it is an extremely difficult task to reconnect the guide brackets with the ends of the beam. More particularly, a workman must raise the guide bracket manually against the biasing force to an elevation corresponding to the level of the beam and then, while overcoming the biasing force, must reattach the guide brackets to the beam ends. In some situations, a workman is not able to manually overcome the biasing force, with the result that the biasing force must be relieved before reattachment can be made.

Because of the problems encountered in reattaching the releasable beam of the roll-up door, there has been a need for a quick and simple manner of reattachment.

SUMMARY OF THE INVENTION

The invention is directed to a roll-up industrial door having a releasable beam and a tensioning mechanism, and having a provision for facilitating reattachment of the beam to the tensioning mechanism after the beam has been separated from the tensioning mechanism by impact.

The door construction of the invention includes a flexible door panel or curtain, which is coiled on a drum located above a doorway in a building and can be moved between a closed position, where the door panel encloses the opening, to an open position, where the door panel is fully wound on the drum.

Attached to the lower end of the door panel is an elongated beam. The ends of the beam are releasably connected to brackets which travel in vertical guide tracks in the side frames of the door which are mounted along the sides of the doorway.

The releasable connection between the beam ends and the guide brackets can be a type described in U.S. patent Application 07/679,770, filed Apr. 3, 1991, now U.S. Pat. No. 5,139,074. With the breakaway mechanism as described in that patent application, a transverse impact applied to the closed or partially open door panel will cause the beam ends to separate or break away from the guide brackets, thus preventing damage to the door panel, guide brackets or other components of the door.

The roll-up door of the invention also includes a counterbalancing and tensioning system for counterbalancing the weight of the door panel and applying a downward tension to the closed door panel to stretch the panel and resist wind deflection. The counterbalancing and/or tensioning system includes a cable or strap interconnecting the drum and each guide bracket, and the cables exert a downward biasing force on the guide brackets.

In accordance with the invention, a pair of belts having the same thickness of the door panel are wound on the drum adjacent the side edges of the door panel, and one end of each belt is connected to the drum while the opposite end of each belt is connected to the respective guide bracket. The belts are wound on the drum in the same number of convolutions as the door panel.

If the beam ends are released from the guide brackets by virtue of the closed or partially open door panel being subject to a transverse impact, the connection of the belts to the guide brackets will resist the biasing force of the tensioning system, and retain the guide brackets in position adjacent the beam ends, so that the ends of the beams can be readily reattached to the guide brackets.

The reattachment of the beam ends to the guide brackets can be readily accomplished by a single workman, for the workman is not required to pull the guide brackets upwardly against the biasing force of the tensioning mechanism. This results in a quick reattachment of the beam to the guide mechanism with minimum effort.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
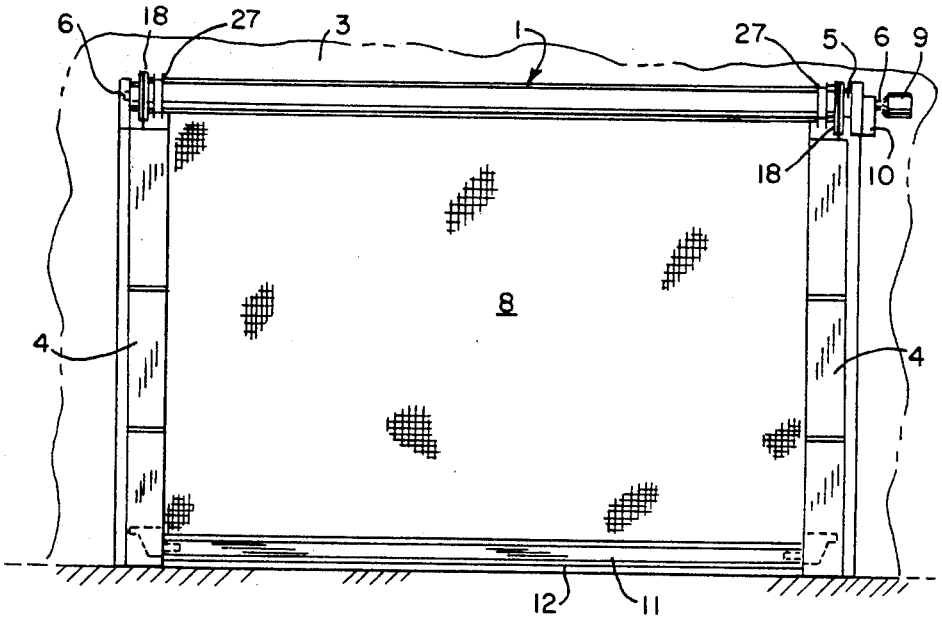
FIG. 1 is a front elevation of a roll-up door incorporating the structure of the invention with the door shown in the closed position.

The drawings illustrate a roll-up door 1 which is adapted to enclose a doorway 2 in a commercial or industrial building 3. The door of the invention includes a releasable or breakaway beam and a retention mechanism for facilitating reattachment of the beam to guide brackets after the beam has been separated by impact.

Door 1 includes a pair of generally box-shaped vertical frame members 4, which are located along the sides or jambs of doorway 2. A cylindrical drum 5 is mounted horizontally above doorway 2 and a shaft 6 projects axially from each end of the drum and is journaled within suitable bearings which are mounted on the upper end of each frame member 4.

A flexible door panel or curtain 8 has one end secured to the outer surface of drum 5 and is adapted to be wound and unwound from the drum. In the unwound condition, panel 8 extends downwardly and encloses doorway 2 as shown in FIG. 1. Door panel 8 is preferably formed of a fabric and is coated with a plastic material, such as polyvinylchloride, or the like.

Door panel 8 can be wound and unwound on drum 5 by a mechanism as disclosed in U.S. Pat. No. 5,048,588. In this regard, a hydraulic motor 9 is connected to one end of shaft 6 through a disc brake mechanism 10. Operation of motor 9 in one direction will cause the panel 8 to unwind from drum 5, while rotation of the motor in the opposite direction will wind the door panel on the drum. Brake 10 is constructed so that it will be in a disengaged condition when the motor 9 is operating and will automatically be engaged when the operation of the motor is terminated so that the brake will then hold the door panel 8 in any given position.

An elongated beam 11 is attached to the lower edge of the door panel 8 and a resilient bumped strip 12, formed of a material such as rubber or plastic, is connected to the lower edge of the beam.

The ends of beam 11 are releasably connected to guide brackets 13 which are mounted for vertical movement within guide tracks 14 formed in the vertical frame members 4. Opposite surfaces of each guide bracket 13 include wear pads 15 composed of nylon or the like, which ride against the surfaces of the guide track.

While the drawings illustrate the guide brackets 13 being guided in tracks 14 by pads 15, it is contemplated that the brackets could also be guided in movement through use of rollers, guide wheels or the like.

The releasable or breakaway connection between the ends of beam 11 and guide brackets 13 can be constructed as shown in co-pending U.S. application Ser. No. 07/679,770 filed Apr. 3, 1991, U.S. Pat. No. 5,139,074, and the construction of that patent is incorporated herein by reference. As disclosed in the aforementioned patent application, beam 11 is flexible in a horizontal direction and the ends of beam 11 are formed with open-ended slots or recesses 16, which receive extensions 17 on the guide brackets 13. If the beam 11 is subjected to a substantial impact, the beam, due to its flexible nature, will bow or deform, causing the beam ends to move relative to the extensions 17, and a predetermined bowing of the beam will release the extensions from the beam ends to prevent permanent damage to the beam and the door panel. Thus, the break away door construction will accommodate minor bumps or impacts without release, and yet will readily release if the beam is subjected to a substantial impact.

Figure 2:
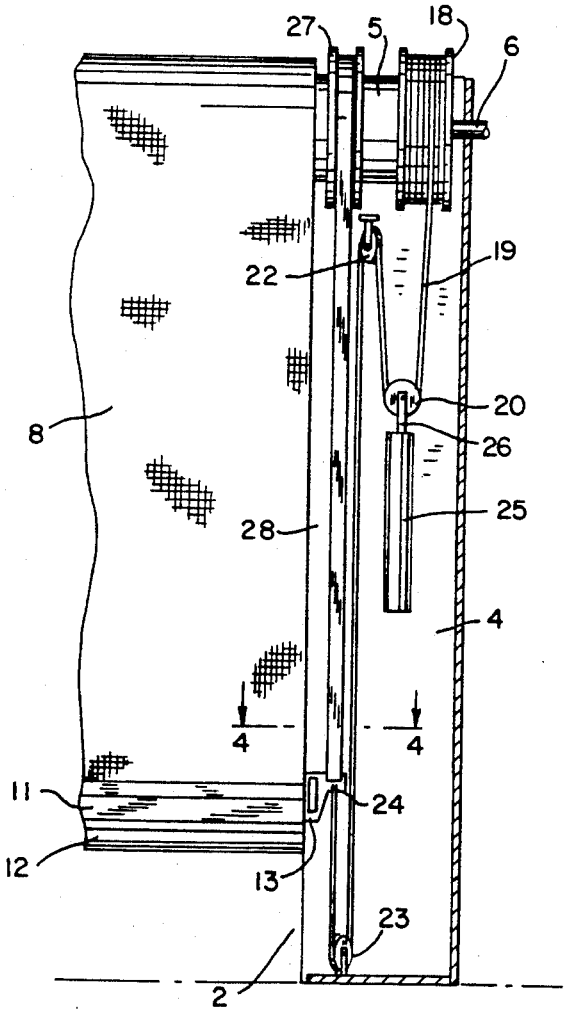
FIG. 2 is a fragmentary front elevation with parts broken away in section.
Figure 3:
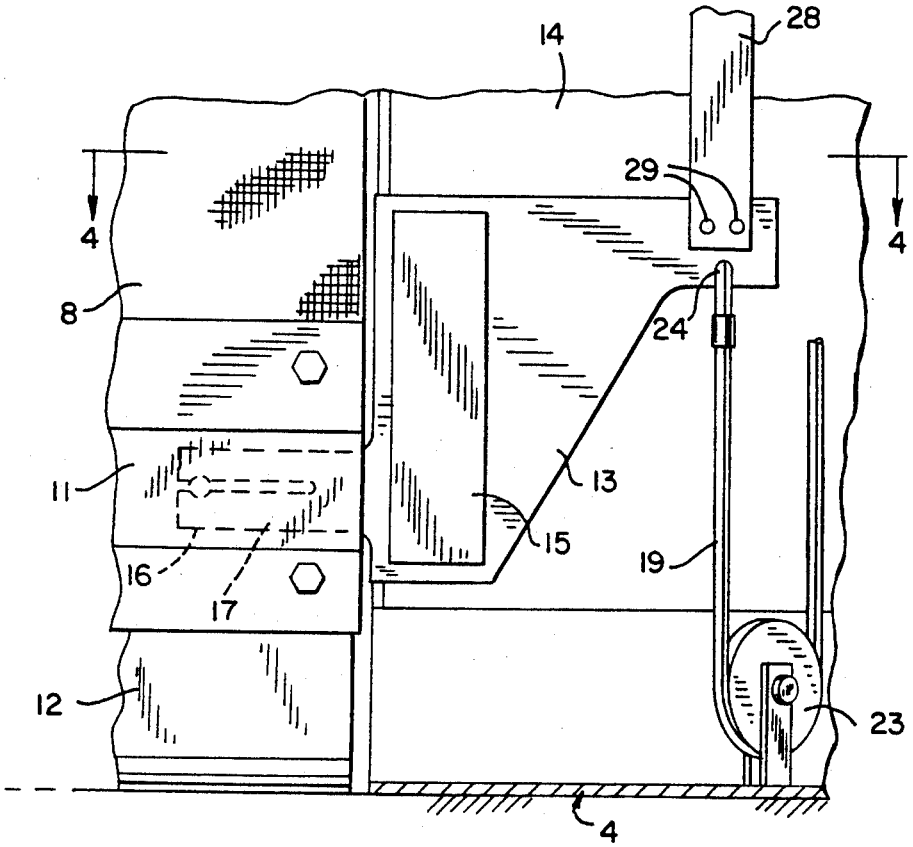
FIG. 3 is an enlarged fragmentary front elevation showing the connection of the beam and the retention mechanism to a guide bracket.
Figure 4:
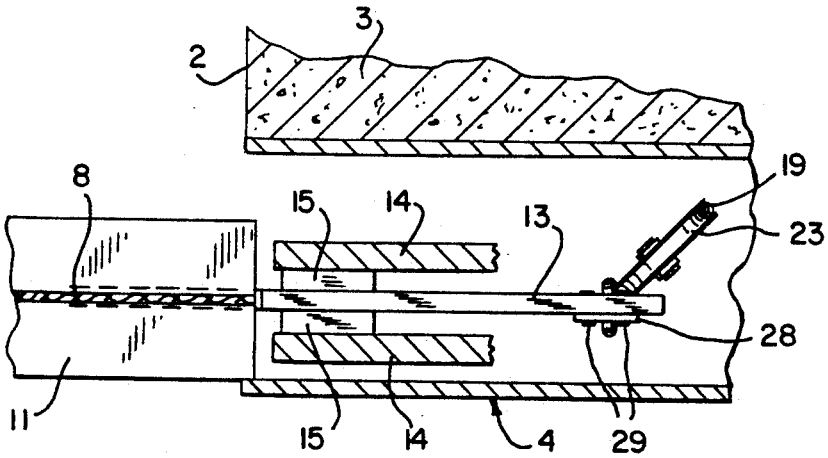
FIG. 4 is a section taken along line 4—4 of FIG. 3.

A counterbalancing and tensioning mechanism is associated with the door panel 8. As seen in FIG. 2, a pair of pulleys 18 are mounted on opposite ends of drum 5, and the pulleys may have a larger diameter than the drum. A flexible member, such as a cable 19, is secured to each pulley 18, and each cable extends downwardly from pulley 18 and passes around pulley 20, then upwardly around pulley 22, then downwardly around pulley 23 and is dead-ended as indicated by 24 on the respective guide bracket 13. Counterweight 25 is attached to pulley 21 through bracket 26 and exerts a downward force on the pulley 21 and cable. Counterweight 25 aids in counterbalancing the weight of the door panel, and with the arrangement of the counterweight and pulleys, the downward force of the counterweight, when the door panel is in the open or raised position, will act through a moment, which will maintain the door in the open position. As the door is lowered, the cable is wound onto the pulley, so that the moment will increase. Thus, the system is designed so that when the door panel is in the closed position, the weight of the door panel will be counterbalanced to require less opening effort. When the door is closed, the counterweight acts to provide a downward biasing force on the guide brackets 13 to maintain tension on the door panel and prevent wind deflection.

While the drawings have illustrated the counterweight 25 as providing both a counterbalancing and tensioning function, it is contemplated that separate counterbalancing and spring tensioning mechanisms can be utilized such as that shown in U.S. Pat. No. 5,048,588.

In accordance with the invention, a pair of pulleys 27 are mounted on each end of drum 5 inboard of the pulleys 18. One end of a belt or strap 28 is secured to each pulley 27 while the opposite end of each belt is connected to the respective guide bracket 13 by fasteners 29.

Belts 28 preferably have the same thickness as the door panel 8 and are wound on the pulleys 27 in the same direction and in the same number of convolutions as the door panel is wound on drum 5. The belts or straps roll-up and down with the door panel 8 and will not interfere with normal opening and closing of the door panel.

If the beam 11 is subjected to an external impact, as for example by a forklift truck engaging the beam, the beam ends 11 will break away from the guide brackets 13 as previously described. With the beam ends released, the belts 28 will resist the biasing force applied to the guide brackets through the cables 19 and will maintain the guide brackets in position, preventing the guide brackets from being pulled downwardly within the guide tracks 14 by the biasing action of the counterweight 25. Thus the guide brackets 13 and the beam ends will be at the same level, so that the beam ends can be readily reattached to the guide brackets.

The reattachment requires minimal manual effort due to the fact that the guide brackets are retained in position by belts 28 and it is not necessary to pull the guide brackets 13 upwardly in tracks 14 against the biasing force. Thus, the reattachment can be accomplished rapidly by a single workman.

While the above description has shown the brackets 13, to which the tensioning mechanism is attached, guided for vertical movement in guide tracks on the side frames 4, it is contemplated that in other installations the brackets, while movable relative to the side frames, may not be mounted for movement in tracks.

Various modes of carrying out the invention are contemplated as being within the scope of the following claims particularly pointing out and distinctly claiming the subject matter which is regarded as the invention.

I claim:

1. A roll door construction to enclose a doorway in a structure, comprising a frame to be mounted to the structure, drum means mounted for rotation on the frame and disposed adjacent the doorway, a flexible door panel disposed in coiled form on said drum means, said door panel being movable between a closed position where said door panel encloses said doorway to an open position where said door panel is wound on said drum means, a bracket mounted to move with the door panel, biasing means operably connected to said bracket for exerting a vertical force on said bracket, releasable connecting means interconnecting a lower side portion of said door panel to the bracket, said releasable connecting means being operable to release said connection when said door panel is subjected to a transverse impact, and means responsive to release of said connecting means for negating the force of said biasing means to thereby maintain said lower side portion and said bracket at the same proximate vertical level.

2. A door construction of claim 1, and including an elongated beam connected to the lower edge of said door panel, said connecting means interconnecting an end of said beam and the bracket.

3. The door construction of claim 1, wherein said means responsive to release of said connecting means comprises a belt, one end of said belt being connected to said drum means and the other end of said belt being connected to the bracket.

4. The door construction of claim 3, wherein said belt has the same thickness as said door panel and is wound in the same number of convolutions on said drum means as said door panel.

5. The door construction of claim 3, wherein said belt is separate from said door panel.

6. The door construction of claim 5, wherein said drum means comprises a cylindrical drum, said door panel and said belt being wound on said drum in side-by-side relation.

7. The door construction of claim 1, wherein said biasing means acts to exert a downward vertical force on said bracket.

8. The door construction of claim 2, wherein said biasing means comprises a flexible member having a first end connected to an end of said beam and having a second end wound on said drum means, said biasing means also including a biasing member connected to the flexible member intermediate the ends of said flexible member.

9. The door construction of claim 8, wherein said biasing member comprises a counterweight.

10. The door construction of claim 8, and including a first pulley mounted on the structure, a second pulley located adjacent said drum means, and a third pulley located between said second pulley and said drum means, said flexible member comprising a cable extending from said bracket around said first pulley and around said second pulley and around said third pulley to said drum means, said biasing member being connected to said third pulley.

11. The door construction of claim 4, wherein said belt is composed of the same material as said door panel.

12. A roll door construction to enclose a doorway in a structure, comprising a frame to be mounted on the structure, a drum mounted for rotation on the frame and disposed adjacent the doorway, a flexible door panel disposed in coiled form on said drum, said door panel being movable between a closed position, where said door panel encloses said doorway, to an open position where said door panel is wound on said drum, a pair of brackets mounted to move with said door panel, an elongated beam connected to the lower edge of said door panel, releasable connecting means interconnecting the ends of the beam to the respective brackets and operable to release when said door panel is subjected to a transverse impact, biasing means operably connected to each bracket for exerting a downward vertical force on said brackets when said door panel is in the closed position, and a pair of belts, one end of each belt being connected to said drum and the other end of each belt being connected to the respective bracket, said belts maintaining the brackets at approximately the same vertical level as the beam on release of said connecting means.

13. The door construction of claim 12, wherein said belts have the same thickness as said door panel and are wound in the same number of convolutions on said drum as said door panel.

14. The door construction of claim 13, wherein said belts are wound in the same direction on said drum as said door panel.

15. The door construction of claim 11, wherein said drum comprises a central section on which said door panel is wound, a pair of first pulleys on said drum each located adjacent a side edge of said central section, said belts being wound on said first pulleys, and a pair of second pulleys on said drum and each disposed outboard of a first pulley, said biasing means including a flexible member interconnecting each second pulley with an end of said beam, said biasing means also including a biasing member operably connected to said flexible member intermediate the ends thereof.

16. The door construction of claim 15, wherein said second pulleys have a greater diameter than said central section, said flexible member being constructed and arranged to be fully wound on said second pulley when said door panel is in the closed position.

17. A roll door construction to enclose a doorway in a structure, comprising a frame to be mounted to the structure, drum means mounted for rotation on the frame and disposed above the doorway, a flexible door panel disposed in coiled form on said drum means, said door panel being movable between a closed position where said door panel encloses said doorway to an open position where said door panel is wound on said drum means, an elongated beam connected to the lower edge of said door panel, a bracket, releasable connecting means interconnecting an end of said beam and the bracket, biasing means of exerting a vertical force on said door panel, said releasable connecting means being operable to release the connection between said beam and said bracket when said door panel is subjected to a transverse impact, and means attached to said bracket for negating the force of said biasing means to thereby maintain said beam and said bracket at the same proximate vertical label on release of said releasable connecting means.

* * * * *

UNITED STATES PATENT AND TRADEMARK OFFICE

CERTIFICATE OF CORRECTION

PATENT NO. : 5,222,541

DATED : June 29, 1993

INVENTOR(S) : TIMOTHY J. HORNBERGER

It is certified that error appears in the above-indentified patent and that said Letters Patent is hereby corrected as shown below:

Col. 8, Line 4, CLAIM 17, Cancel "of" and insert --for--;

Col. 8, Line 11, CLAIM 17, Cancel "label" and substitute therefor --level--

Signed and Sealed this

Twenty-third Day of August, 1994

*Attest:*

Bruce Lehman

BRUCE LEHMAN

*Attesting Officer*

*Commissioner of Patents and Trademarks*